US010870145B2

(12) United States Patent
Badent et al.

(10) Patent No.: US 10,870,145 B2
(45) Date of Patent: Dec. 22, 2020

(54) DEVICE FOR ATTACHING A JOINING ELEMENT TO A COMPONENT SECTION, AND TOOL

(71) Applicant: TOX PRESSOTECHNIK GMBH & CO. KG, Weingarten (DE)

(72) Inventors: Michael Badent, Weingarten (DE); Roland Wendt, Argenbuehl (DE)

(73) Assignee: TOX PRESSOTECHNIK GmbH & Co. KG, Weingarten (DE)

( * ) Notice: Subject to any disclaimer, the term of this patent is extended or adjusted under 35 U.S.C. 154(b) by 167 days.

(21) Appl. No.: 15/156,479

(22) Filed: May 17, 2016

(65) Prior Publication Data

US 2016/0279695 A1 Sep. 29, 2016

Related U.S. Application Data

(63) Continuation of application No. PCT/EP2014/073654, filed on Nov. 4, 2014.

(30) Foreign Application Priority Data

Nov. 22, 2013 (DE) ..... 10 2013 019 519

(51) Int. Cl.
*B21J 15/32* (2006.01)
*B21J 15/02* (2006.01)
*B21J 15/10* (2006.01)

(52) U.S. Cl.
CPC ..... *B21J 15/32* (2013.01); *B21J 15/025* (2013.01); *B21J 15/10* (2013.01)

(58) Field of Classification Search
CPC ..... B21J 15/025; B21J 15/02; B21J 15/32; B25C 1/005; B25C 1/00; B25C 1/04; B25C 1/08; B25C 7/00
(Continued)

(56) References Cited

U.S. PATENT DOCUMENTS 3,647,129 A * 3/1972 Ehrlich ..... B23K 9/206 227/112
3,906,615 A * 9/1975 Campbell, Jr. ..... B25C 5/1606 29/432
(Continued)

FOREIGN PATENT DOCUMENTS

DE 195 12 198 A1 10/1996
DE 10 2008 051 488 A1 4/2010
(Continued)

OTHER PUBLICATIONS

International Preliminary Report on Patentability (PCT/EP2014/073654) dated Jun. 2, 2016.
(Continued)

*Primary Examiner* — Tyrone V Hall, Jr.
*Assistant Examiner* — Seahee Hong
(74) *Attorney, Agent, or Firm* — Burr & Brown, PLLC

(57) ABSTRACT

A device for attaching a joining element to a component section, which device is for a tool for attaching the joining element to the component section, wherein the joining element is adapted to be temporarily placed in a holding position and then shifted out of the holding position onto the component section by a linearly movable punch of the tool, wherein the joining element is temporarily placed in the holding position by means for providing a pressure difference in a region of the holding position, wherein the pressure difference on the temporarily placed joining element provides a holding force that acts on the joining element, so that the joining element is held positionally fixed in the holding position.

7 Claims, 2 Drawing Sheets

(58) Field of Classification Search
USPC ..... 227/130, 112, 120, 119, 8; 29/243.53, 29/525.06
See application file for complete search history.

(56) References Cited

U.S. PATENT DOCUMENTS 4,027,520 A * 6/1977 Klein ..... B21J 15/105 29/509
4,363,573 A * 12/1982 Ginther ..... B65G 51/02 221/278
4,609,134 A * 9/1986 Davern ..... B25C 1/001 227/112
5,020,712 A * 6/1991 Monacelli ..... B25C 1/04 227/120
5,480,087 A * 1/1996 Young ..... B23P 19/003 221/268
5,964,393 A * 10/1999 Feldpausch ..... B21J 15/32 227/135
6,374,474 B1 * 4/2002 Rossler ..... B21J 15/105 29/243.523
6,592,015 B1 * 7/2003 Gostylla ..... B25B 23/04 227/112
8,777,080 B2 * 7/2014 Draht ..... B23P 19/003 227/119
10,307,815 B2 * 6/2019 Badent ..... B21J 15/025
2003/0182786 A1 * 10/2003 Fritsche ..... B25B 23/04 29/428
2004/0022588 A1 * 2/2004 Roessler ..... B21J 15/32 406/72
2007/0049067 A1 * 3/2007 Hain ..... B21J 15/32 439/74
2010/0327038 A1 * 12/2010 Tamura ..... B25C 1/08 227/9
2011/0113623 A1 * 5/2011 Tomchick ..... B21D 43/00 29/809
2011/0290847 A1 * 12/2011 Drant ..... B23P 19/003 227/119

FOREIGN PATENT DOCUMENTS

DE 197 81 832 B3 8/2012
WO 01/97999 A2 12/2001

OTHER PUBLICATIONS

German Search Report (Application No. 10 2013 019 519.5) dated Jul. 23, 2014.
International Search Report and Written Opinion (Application No. PCT/EP2014/073654) dated Feb. 5, 2015.

* cited by examiner

DEVICE FOR ATTACHING A JOINING ELEMENT TO A COMPONENT SECTION, AND TOOL

CROSS REFERENCE TO RELATED APPLICATIONS

This application is a continuation of International Application No. PCT/EP2014/073654 filed Nov. 4, 2014, which designated the United States, and claims the benefit under 35 USC § 119(a)-(d) of German Application No. 10 2013 019 519.5 filed Nov. 22, 2013, the entirety of which is incorporated herein by reference.

FIELD OF THE INVENTION

The present invention relates to a device for attaching a joining element to a component section, and tool.

BACKGROUND OF THE INVENTION

Devices or tools for attaching joining elements to components are known, for instance riveting tools. With such tools, joining elements, such as, for instance, functional elements or semihollow punch rivets, solid punch rivets or clinch rivets can be machined. Prior to their attachment to the component, the joining elements provided for a joining point on the component must be moved up to the component from a holding position on or in the tool.

SUMMARY OF THE INVENTION

The object of the present invention is to improve devices or tools stated in the introduction, in particular with regard to providing joining elements on the tool in a manner which is space saving and is uncritical of malfunctions.

The present invention is based on a device for attaching a joining element to a component section, which device is for a tool for attaching a joining element to a component section, the tool comprising a linearly movable punch, with which a joining element which has been temporarily placed in a holding position can be shifted out of the holding position onto the component section.

In particular, the present invention relates to a device for a joining or riveting tool for semihollow punch riveting, solid punch riveting, clinch riveting, or for machining of other joining elements.

Tools of this type comprise a punch arrangement having a driven linearly movable punch element or punch, generally having a hold-down clamp present around the outside of the punch, and further comprise an oppositely arranged die unit. Between the punch arrangement and the die unit is positioned the component section, for example, two or more material layers of sheet metal and or other materials, for the attachment of the joining element. The punch receives from a withdrawn position a joining element, waiting in the holding position, for further machining, and leads the joining element to the joining point on the component section, where it is firmly anchored to, for example, force fitted onto, the component section.

The tools in question are frequently configured with a C-shaped tool part or a so-called C-frame, comprising the punch arrangement and the die unit.

As the component section can be understood, for instance, sheet-like components, for example, single-layered or multilayered planar components. With the tool, two or more component layers, where appropriate, can be connected to one another.

The core of the present invention lies in the fact that means for providing a pressure difference are present in the region of a temporarily placed joining element, wherein the pressure difference, which can be provided by way of the means, on a temporarily placed joining element leads to a situation in which a holding force acts on the joining element, so that the joining element is held positionally fixed in the holding position.

Hence a joining element is held on the device or on the tool advantageously in the holding position. Proposed, in particular, is an arrangement which, as far as a clear motional path of the punch is concerned, has no critical interfering contour due to holding mechanisms for the joining element. Advantageously, for the realization of the pressure difference, in particular no components or elements which extend, for example, movably, to the holding position, as is the case with known arrangements, are necessary. These elements lead repeatedly to collisions with the moving punch.

Moreover, the pressure difference can advantageously be realized, in particular, with a frequently present pneumatic arrangement. In the case of riveting or joining tools, pneumatic arrangements are regularly required, for example, to transport joining elements, from a store or holding position for a plurality of joining elements, to the tool.

It is advantageous if the joining element held with the pressure difference is bearingly pressed against or sucked up against a mechanical stop. The mechanical stop can be tailored to a section of an external shape of the joining element that comes into contact against the stop in the holding position of the joining element, whereby, by form closure or surface contact, a contact pressure which is additionally in force in this region of the contact supports or enhances a holding function for the joining element.

The pressure difference acting on the joining element can be established, for example, by an increase or reduction in air pressure in the vicinity of the joining element in the holding position. The pressure difference can be provided statically or dynamically or by a gas stream.

In addition, it is advantageous that blower means for providing a directed gas stream are present in the region of a temporarily placed joining element, wherein the gas stream flows around the joining element in such a way that a holding force on the joining element can be provided, which holding force holds the joining element in the holding position.

The joining element is pressed by the gas stream or pneumatically into the desired holding position and remains held there. The directed gas stream produces, in particular, a force acting on the joining element, such that a displacement or away movement of the joining element from the holding position due to gravitational force or the own weight of the joining element is prevented.

The directed gas stream can be directed, in particular, horizontally or transversely to a vertical motional direction of the punch. Generally, a joining element is held in the holding position with its longitudinal axis in alignment with or parallelly offset from the longitudinal axis of the punch. The punch is here in a withdrawn position in relation to the component section, so that the joining element is held between the front end of the withdrawn punch and the component section in a standby position or the holding position or fetching position. The gas stream onto the joining element can hence be directed at the joining element, for example, transversely or obliquely to the motional direction of the punch or of the longitudinal axis of the joining element. In the direction of flow of the gas stream, after or behind the joining element or, where appropriate, laterally therefrom, volume regions or outflow paths for the escape or discharge of the gas stream shall advantageously be provided.

From the holding position, the temporarily placed joining element can be moved up to the component section by a linear forward movement of the punch. The punch here surmounts the holding force on the joining element and transports the joining element by pushing this joining element ahead of the punch.

It is not precluded that the gas stream, at the moment of reaching the holding position, changes its outflow path. This can be the case, for instance, when the off-flowing gas stream is evacuated behind the joining element via an outflow opening, yet, once the holding position of the joining element is reached, the outflow opening is closed off. From this moment, the gas stream is guided, for example, laterally past the joining element via other discharge paths. When the joining element is subsequently transported by the punch, the outflow opening is also opened up, whereupon the next joining element is pressed by the gas stream into the holding position.

Where appropriate, it can be arranged that a low pressure or negative pressure is applied in the closed outflow opening, whereby in this region a negative pressure or suction holding force acts on the joining element in the holding position.

Furthermore, it is advantageous that a wall section, which extends to a region occupiable by a joining element in the holding position, is configured such that a joining element reaching the holding position, under the effect of the gas stream, occupies the holding position in a positionally correctly oriented manner. The joining element is delivered, for example, via a feed line to the holding position such that the joining element reaches the region of the holding position already in at least approximately positionally correct alignment. The wall section can be tailored such that, under the effect of the pressure difference or of the gas stream on the outside of the joining element, this joining element, via a punctiform, linear and/or full-faced contact with the wall section, occupies the holding position in the exactly desired orientation.

In addition, it is of advantage that the wall section is configured tailored to an outer contour of the joining element. If the wall section in question is designed tailored to the corresponding region of the outer contour of the joining element, or forms, for example, its negative form, the joining element can be brought, under the effect of the gas stream, exactly into the desired holding position in which the section of the outer contour of the joining element bears in a precise-fitting manner or, where appropriate, snugly against the wall section.

It is advantageous, moreover, that the blower means are configured to move a joining element with the aid of the gas stream from an end of a supply section, with which gas stream a joining element can be led up to the device by pipeline, to the holding site. In addition to the provision of the holding force, the gas stream is advantageously used as a transport medium for the directed movement of a joining element in order to transport this from an end of a feed line, which end extends to the device or the tool, up to the holding position. This is generally a comparatively short distance. Advantageously, the transport of the joining elements in the feed line is likewise realized pneumatically or under the effect of a directed gas stream. This gas stream then serves also to hold the respective joining element in the holding position.

An alternative advantageous variant of the present invention is distinguished by the fact that, in a region in which a joining element occupies the holding position, discharge sections for leading away the directed gas stream are present. Thus the gas stream can be purposefully guided past the outside of the joining element in the holding position such that the holding force is optimized.

The discharge section can be configured on a, in relation to the incident flow direction of the gas stream, rear side of the held joining element, for example, as at least one evacuation line for the gas stream.

The incident flow through the gas stream is realized preferably from the direction from which the joining element is delivered to the holding position via a supply line. Thus the joining element reaches the holding position in the direction of the feed movement.

It is also advantageous that a negative pressure arrangement for generating a negative gas pressure is present in the region of the holding position. For instance, a negative pressure pump or vacuum pump can be provided, which pump, in the region of the holding position, for example in a low pressure bore extending to the holding position, generates a negative pressure or extracts the air which is present there. The negative pressure must be arranged such that a resultant suction force acting on the joining element draws the joining element into the holding position.

The negative pressure arrangement can advantageously be configured to check the presence of a joining element with respect to the holding position. Additionally to the holding function or alternatively to the holding function, the negative pressure arrangement can serve to check whether a joining element is present at the holding position or is correctly present. This can be done, for example, with an arrangement which comprises, for example, a sensor and/or a pressure switch for measuring a negative or low pressure in a low pressure bore which extends to the joining element in the holding position. The arrangement in question can detect whether or not a semihollow punch rivet is present under the punch or in the holding position.

Thus a presence check for a temporarily placed joining element, for instance combined with a holding function by low pressure, can be provided.

In addition, it is advantageous that a positive pressure arrangement for generating a positive gas pressure is present in the region of the holding position. The positive pressure is preferably arranged such that, for example with a pneumatic arrangement, a resultant compressive force acting on the joining element presses the joining element into the holding position. The positive gas pressure is advantageously arranged with a purposefully oriented gas stream, in particular with a continuous and/or constant gas stream or air stream.

It is further advantageous that the blower means are configured to generate a gas stream, so that gas flows in onto a joining element present in the holding position. Hence the holding force can stably be realized, in particular, reproducibly. Advantageously, via the gas stream, a positive pressure can be generated in the region of the holding position in order to provide the desired or necessary holding force acting on the joining element. If the joining element has a greater weight, a correspondingly higher holding force can be established than with a lighter joining element, in which then, where appropriate, a smaller gas volume stream or positive gas pressure in comparison with a heavier joining element is sufficient, assuming otherwise same conditions.

It is also advantageous that the blower means are configured to generate a gas stream, so that gas flows away from a joining element present in the holding position. Hence, with the gas stream, a negative pressure can be generated at the joining element, so that a corresponding negative pressure holding force holds the joining element stably in the holding position. Via the level of the negative pressure, the holding force can likewise be determined in terms of magnitude and level.

According to an advantageous embodiment of the present invention, the holding position is configured, along a path which can be covered by the punch, between a withdrawn position and a position extended in the direction of a component section. Hence the joining element at the holding position is advantageously transported by the punch.

Moreover, with an arrangement according to the present invention it is possible, for instance via a control unit for controlling the operation of the tool, to reduce or eliminate the pressure difference, and thus the holding force at the holding position, when the punch transports the joining element out of the holding position in the direction of the component section.

It is also possible, however, to permanently obtain the pressure difference. The punch can apply a many times greater force than the holding force to the joining element in order to release it from the holding position and can thus release the joining element and transport it in the direction of the component section. Advantageously, the punch does not have to move toward the joining element in a manner tailored to physical holding means in the vicinity of the held joining element, since, with the pressure difference, no such physical holding means exist or such can be dispensed with. A possible risk of collision risk of the punch when fetching the joining element held according to the invention by differential pressure is thereby avoided.

The present invention additionally relates to a tool for attaching a joining element to a component section, the tool comprising a linearly movable punch, wherein a device according to one of the aforementioned variants is present.

BRIEF DESCRIPTION OF THE DRAWINGS

Further features and advantages of the present invention are explained in greater detail on the basis of a schematically represented illustrative embodiment of a tool according to the invention. More specifically.

DETAILED DESCRIPTION OF THE INVENTION

Figure 1:
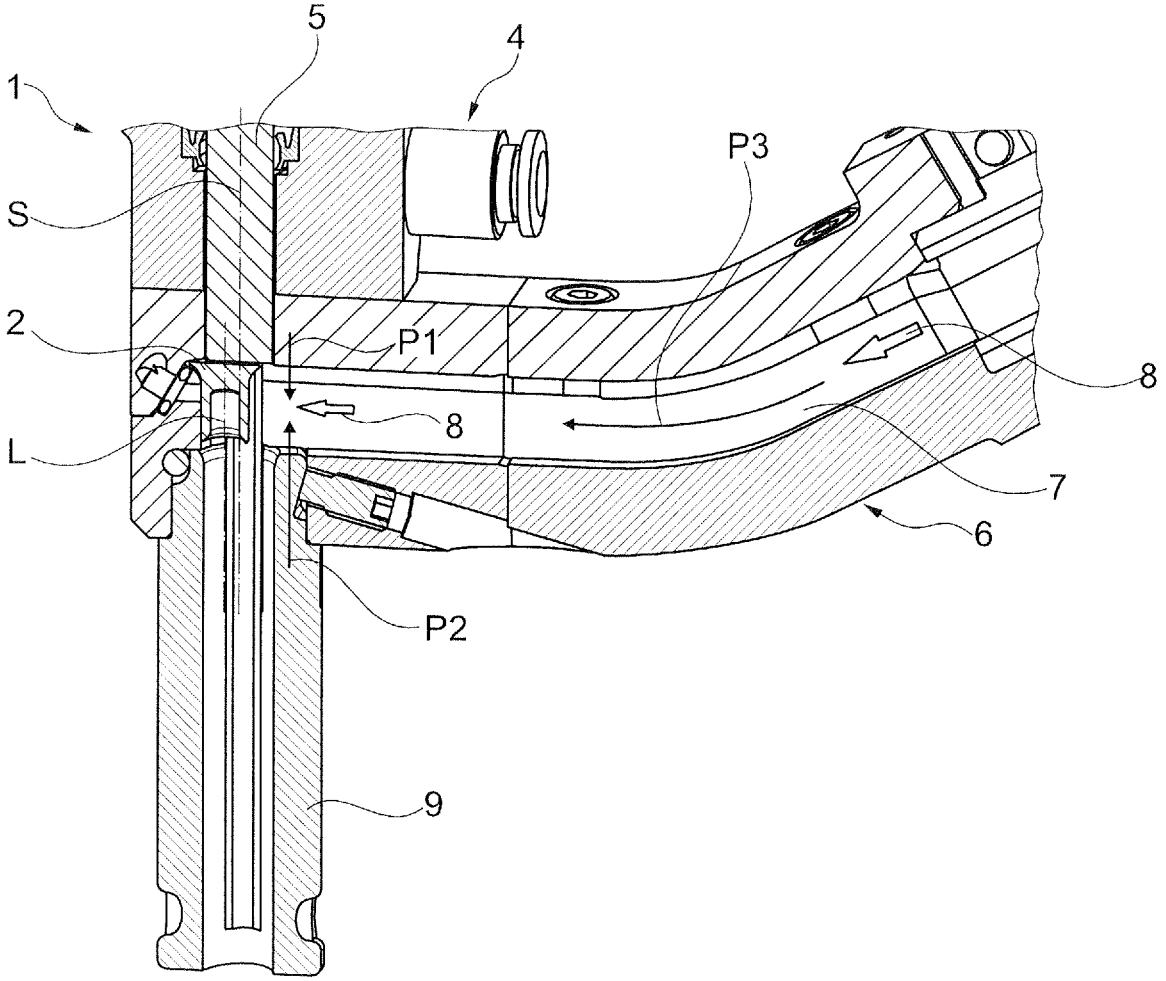
FIG. 1 shows a part of a tool according to the invention in section along a tool axis.
Figure 2:
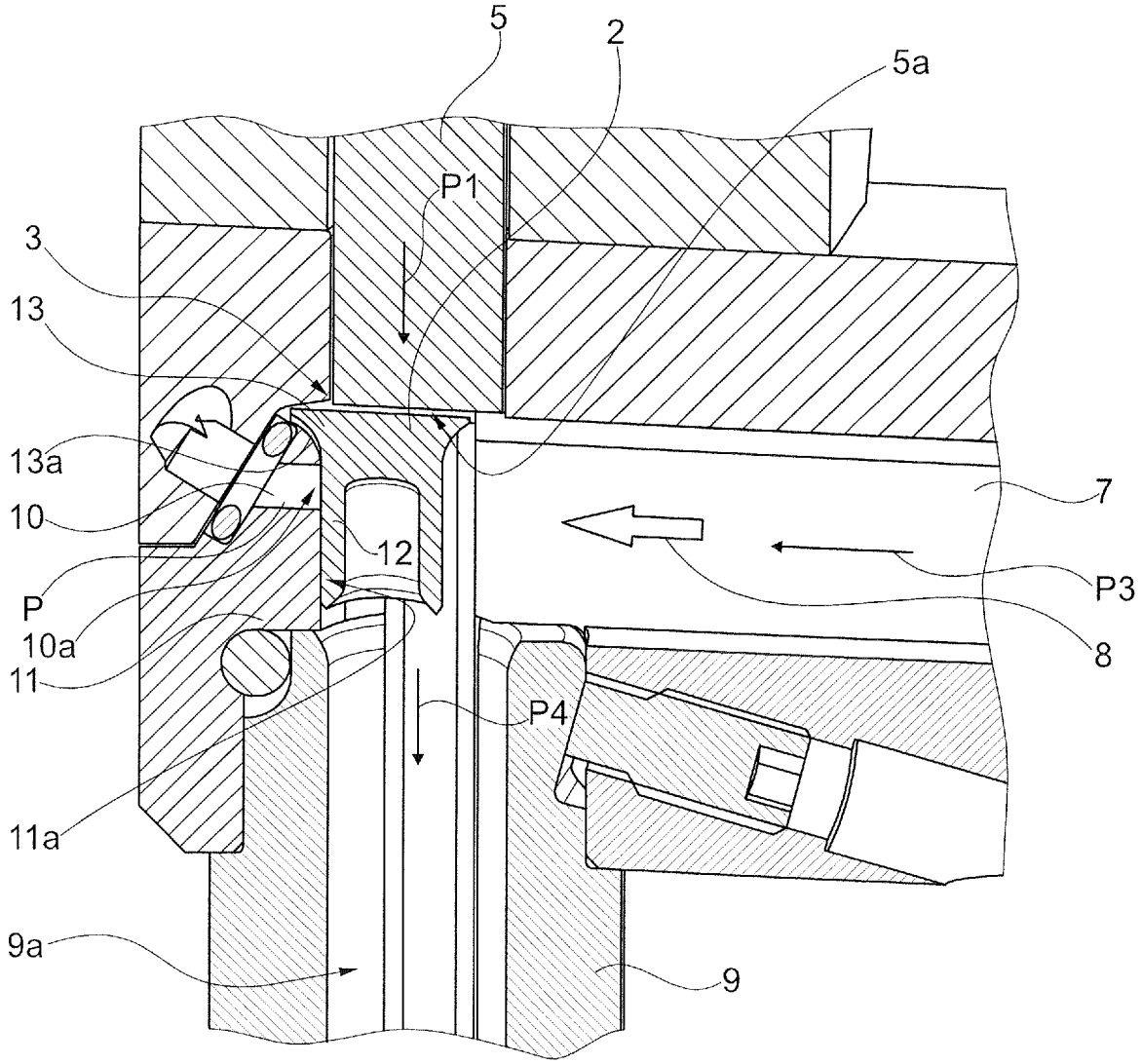
FIG. 2 shows an enlarged detail from FIG. 1.

In FIGS. 1-2, a part of a tool according to the present invention, configured as a riveting tool 1, for the machining of joining elements is represented, wherein, by way of example, a joining element designed as a semihollow punch rivet 2 is machined. The semihollow punch rivet 2 is held in a detention or holding position 3 in the riveting tool 1. The semihollow punch riveting tool 1 serves to insert the semihollow punch rivet 2 in, for example, two or more material layers (not shown), which consist, for instance, of a metallic or other material.

For the positioning of the semihollow punch rivet 2 in the holding position 3 on the riveting tool 1, the semihollow punch rivet 2 is conveyed from a store, remote from the actual riveting tool 1, for a multiplicity of semihollow punch rivets via, for example, a feed tube (not visible) and a feed 6 adjoining thereto on the tool side and having a feed channel 7 for the semihollow punch rivet, in the direction P3 into a rivet setting head 4 of the riveting tool 1. A punch of the riveting tool 1, which punch is movable linearly to and fro according to the arrows P1 and P2 by means of a drive unit of the tool 1 and is configured as a rivet setting pin 5, respectively transports an individual semihollow punch rivet 2 out of the holding position 3 in the direction P4, and presses the semihollow punch rivet 2 in a joining process, for example, into a sheet stack in order to bring the sheets into an at least positively connected state.

The sectional representations in FIGS. 1 and 2 are derived from a section along the longitudinal axis of the rivet setting pin 5.

In the state extended in the direction of a die unit (not shown) of the riveting tool 1, the rivet setting pin 5 is surrounded peripherally on the outside by a hold-down clamp configured as a hold-down nose 9. The material layers in question, such as, for example, a sheet stack, rest during the joining process with a bottom side on a die arrangement of the riveting tool 1, wherein the hold-down nose 9 fixes the sheet stack by pressure application from above or on the punch side.

The semihollow punch rivet 2 is led up from the store into the rivet setting head 4 not in the axial direction or in the direction of the longitudinal axis L of the semihollow punch rivet 2, but in the transverse direction to the longitudinal axis L of the semihollow punch rivet 2, by the feed 6. Thus the semihollow punch rivet 2 can advantageously be shot directly under the rivet setting pin 5, whereby an otherwise necessary mechanism, for example a pusher mechanism, which rotates the semihollow punch rivet 2 through 90 angular degrees before the punch pushes the semihollow punch rivet 2 onward in the direction P4 according to the orientation shown in FIGS. 1 and 2, with a rivet bottom side to the fore, can be dispensed with.

The semihollow punch rivet 2 is conveyed by means of an air stream 8 in the direction 23 and is injected directly under the rivet setting pin 5 or its front or end-side flat end face 5*a* and held there positionally fixed in oriented arrangement in a holding position 3, as is shown by FIGS. 1 and 2. The semihollow punch rivet 2 is here secured by a pressure difference acting, in accordance with the air stream 8, on the outside of the semihollow punch rivet 2. In order that the semihollow punch rivet 2 in the holding position 3 is held by the pressure difference, an evacuation line for the air is present, for example, on a side of the held semihollow punch rivet 2 that is to the rear of the inflowing air stream 8. The semihollow punch rivet 2 is thus pressed into the holding position 3 and remains there as long as the air stream 8 or a pressure difference exists.

In the present illustrative embodiment there is provided a low pressure bore 10, in which, in relation to a reference pressure, such as, for example, ambient or atmospheric pressure, a negative pressure or low pressure prevails. When the semihollow punch rivet 2 reaches the holding position 3 and closes off an opening 10*a* of the low pressure bore 10, the semihollow punch rivet 2, due to the negative pressure in the low pressure bore 10, is sucked up against the opening 10*a* and remains in the holding position 3. With the negative pressure in the low pressure bore 10, on the one hand, and a thereto higher, for example, ambient pressure in the remaining region around the semihollow punch rivet 2, a pressure difference takes effect at the semihollow punch rivet 2, which pressure difference secures the semihollow punch rivet 2 in the holding position. The negative pressure in the low pressure bore 10 can be established, for example, by an extraction or vacuum arrangement, which extracts air from the low pressure bore 10.

With the present invention, an otherwise necessary mechanism for mechanically holding the semihollow punch rivet 2 in the holding position 3, such as, for instance, a pusher mechanism, can advantageously be dispensed with.

Hitherto it has been disadvantageous that a guidance of a semihollow punch rivet through a rivet setting head and the holding thereof places comparatively high requirements on the reliability of the mechanism with regard to a smallest possible interfering contour of the rivet setting head.

The location of the semihollow punch rivet 2 in the rivet setting head 4 must always be clear, in particular in the transfer of its motional direction from a transverse motional direction to beneath the rivet setting pin 5 to an axial motional direction in which the rivet setting pin 5 pushes the semihollow punch rivet 2 through the hold-down nose 9. If the semihollow punch rivet 2 is tilted or twisted, even if only slightly, in the riveting tool 1 or in the rivet setting head 4, this leads in most cases to damage to or destruction of components of the rivet setting head 4. It is here that the present invention is advantageous compared to existing devices.

For, according to the present invention, the semihollow punch rivet 2 is not held under the rivet setting pin 5 by a holding mechanism, but by a differential pressure, for example by negative pressure in the low pressure bore 10 or positive pressure from the side of the feed channel 7.

The transfer from the lateral, for example, horizontal feed of the semihollow punch rivet 2 according to P3 into the onward movement of the semihollow punch rivet 2 is realized by the rivet setting pin 5 in a continuous path without interfering contours and/or without component offsets. As a result, a continuous, low-wear transport of the semihollow punch rivet 2 in the riveting tool 1 is ensured.

The semihollow punch rivet 2 is conveyed or blown in under the rivet setting pin 5 in particular by negative pressure or positive pressure, though other options, for example, by gravitational force, are also conceivable.

The holding force on the semihollow punch rivet 2 by virtue of the negative pressure p in force in the holding position 3 departs as soon as the semihollow punch rivet 2 is pressed minimally or slightly out of the holding position 3 by action of the down-moving rivet setting pin 5. Holding sections on the rivet setting head 4 which come into contact against the semihollow punch rivet 2 then take over the positioning or guidance of the semihollow punch rivet 2. Here, the semihollow punch rivet 2 is always moved in a defined oriented manner.

The semihollow punch rivet 2 which is fired into the rivet setting head 4 according to 23 transversely to the motional direction P1, P2 of the rivet setting pin 5 meets the bearing contour of a stop 11. The stop 11 forms, opposite to the feed channel 7, a part of a movement channel for the rivet setting pin 5 in the region of the holding position 3.

The stop 11 is located directly below the rivet setting pin 5 in its position, according to FIGS. 1 and 2, fully withdrawn in the direction P2. The shape of the wall 11*a* of the stop 11 is shell-like, with a radius which roughly corresponds to an outer radius of a shank 12 of the semihollow punch rivet 2, which outer radius is equal for all differently long semihollow punch rivets 2 machinable with the riveting tool. The wall 11*a* is drilled through and the low pressure bore 10 formed thereby is subjected to negative pressure. As a result, the semihollow punch rivet 2 or its shank 12 is sucked against the wall 11*a* and the semihollow punch rivet 2 is held in the holding position 3. The low pressure bore 10 runs through the rivet setting head 4 at a suitable site, in particular in a region of the riveting tool 1 that is uncritical to an interfering contour, at which site, for example, a sensor and/or a pressure switch can detect, by measuring the negative pressure or low pressure in the low pressure bore 10, whether a semihollow punch rivet is under the rivet setting pin 5 or not. Hence, by low pressure combined with the holding function, a presence check for a held semihollow punch rivet 2 is provided. In this way, a multiplicity, for instance several tens of thousands, of semihollow punch rivets can be treated such that the semihollow punch rivet 2 is reliably sucked up in all spatial positions of the rivet setting head 4, and that the low pressure bore 10 is not clogged up as a result of abrasion.

Moreover, an air filter, with which the sensor is kept free of particles caused, for example, by abrasion from the feed tube or the feed 6, or a coating of the semihollow punch rivet 2, can be provided in the low pressure bore 10. The sensor, for example, a pressure sensor, can additionally check in a further function whether the air filter is blocked.

Viewed in the direction P3, a rivet head 13 is found with a fillet 13*a* in an at least almost form-fitting contact against the correspondingly convexly shaped section of the wall 11*a*. Along this, the semihollow punch rivet 2 can in the first movement segment be shifted out of the holding position 3 by the rivet setting pin 5 in the direction P4 and, at the same time, somewhat counter to the direction P3, until the longitudinal axis L of the semihollow punch rivet 2 and the longitudinal axis S of the punch correspond.

In order to ensure that the semihollow punch rivet 2 can be moved forward by the advancing rivet setting pin 5, the longitudinal axis of the stop 11, in relation to the punch longitudinal axis S, is slightly offset, so that the incoming semihollow punch rivet 2 with the air stream 8 flies somewhat further or over the middle of a hollow punch channel 9*a* in the hold-down nose 9. Hence the semihollow punch rivet 2 is moved slightly in relative position, by the advancing rivet setting pin 5, in relation to the end face 5*a* of the rivet setting pin 5, to be precise back in the direction of the feed channel 7. Once the rivet head 13 has moved out of its form-fitting location on the wall 11*a*, it is led onward in the hold-down nose 9 by the cylindrical wall of the punch channel 9*a*. As a result of the advance of the rivet setting pin 5, the semihollow punch rivet 2 is moved automatically from its form-fitting location out of the holding position 3, without a mechanical lever or a catch, for example, having to be activated.

With the arrangement according to the present invention, the semihollow punch rivet 2 is securely held in all spatial positional locations of the rivet setting head 4, in particular including in an overhead location of the rivet setting head 4.

REFERENCE SYMBOL LIST

1 riveting tool
2 semihollow punch rivet
3 holding position
4 rivet setting head
5 rivet setting pin
5*a* end face
6 feed
7 feed channel
8 air stream
9 hold-down nose

9*a* punch channel
10 low pressure bore
10*a* opening
11 stop
11*a* wall
12 shank
13 rivet head
13*a* fillet

The invention claimed is:

1. A riveting tool for attaching a joining element to a component section, the riveting tool comprising:

a linearly movable punch;

a holding position;

a wall section in the region of the holding position; and a bore having an outflow opening proximate the holding position;

wherein the joining element is initially temporarily placed in the holding position by a pressure difference between a positive pressure from a positive pressure directed gas stream flowing in a region of the holding position on one lateral side of the joining element and a negative pressure from a negative pressure directed gas stream flowing in the region of the holding position on the opposite lateral side of the joining element;

wherein the negative pressure directed gas stream is provided in the vicinity of the holding position via the outflow opening of the bore, which is in communication with a vacuum pump;

wherein the pressure difference on the temporarily placed joining element exerts a holding force that acts on the joining element so that the joining element is held positionally fixed in the holding position;

wherein the wall section receives and retains the joining element such that when the joining element initially reaches the holding position under the effect of the pressure difference, the joining element occupies the holding position in a positionally and orientationally desired manner, and the opposite lateral side of the joining element is pressed laterally against the wall section via the negative pressure directed gas stream applied on the opposite lateral side of the joining element;

wherein the negative pressure directed gas stream is evacuated via the outflow opening in the bore, so that when the joining element is in the holding position, the outflow opening is closed off by the joining element; and wherein the joining element is shifted out of the holding position onto the component section by the linearly movable punch.

2. The riveting tool as claimed in claim 1, wherein the wall section has a shape that matches an outer contour shape of the joining element.

3. The riveting tool as claimed in claim 1, further comprising:

a supply section for supplying the joining element; and a pipeline that leads from the supply section to the holding position;

wherein the positive pressure directed gas stream on the one lateral side of the joining element moves the joining element from an end of the supply section via the pipeline up to the holding position.

4. The riveting tool as claimed in claim 1, further comprising a discharge section in communication with the outflow opening of the bore in the region of the holding position that leads away the negative pressure directed gas stream.

5. The riveting tool as claimed in claim 1, wherein the positive pressure directed gas stream flows onto the one lateral side of the joining element present in the holding position.

6. The riveting tool as claimed in claim 1, wherein the negative pressure directed gas stream flows away from the joining element on the opposite lateral side of the joining element present in the holding position.

7. The riveting tool as claimed in claim 1, wherein the holding position is located along a path of the linearly movable punch, between a punch withdrawn position and a punch extended position in the direction of the component section.

* * * * *